US008573753B2

(12) United States Patent
Shimosato

(10) Patent No.: US 8,573,753 B2
(45) Date of Patent: Nov. 5, 2013

(54) INKJET HEAD AND METHOD OF MANUFACTURING THE INKJET HEAD

(75) Inventor: Masashi Shimosato, Mishima (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/495,147

(22) Filed: Jun. 13, 2012

(65) Prior Publication Data

US 2013/0050338 A1 Feb. 28, 2013

(30) Foreign Application Priority Data

Aug. 26, 2011 (JP) ..... 2011-184540

(51) Int. Cl.
*B41J 2/045* (2006.01)

(52) U.S. Cl.
USPC ..... 347/68; 347/47

(58) Field of Classification Search
USPC ..... 347/6–72
See application file for complete search history.

(56) References Cited

U.S. PATENT DOCUMENTS

| | | | | |
|---|---|---|---|---|
| 6,488,355 | B2 * | 12/2002 | Nakamura et al. | 347/40 |
| 7,290,865 | B2 * | 11/2007 | Hibi et al. | 347/68 |
| 7,699,442 | B2 * | 4/2010 | Lim et al. | 347/70 |

FOREIGN PATENT DOCUMENTS

| | | |
|---|---|---|
| JP | 08-058090 | 3/1996 |
| JP | 09-164726 | 6/1997 |
| JP | 10-315460 | 12/1998 |
| JP | 10-315470 | 12/1998 |
| JP | 2002-240305 | 8/2002 |
| JP | 2005-349753 | 12/2005 |
| JP | 2011-037057 | 2/2011 |
| WO | 2008-139949 | 11/2008 |

OTHER PUBLICATIONS

Japanese Office Action for Japanese Patent Application No. 2011-184540 mailed on Jul. 30, 2013.

* cited by examiner

*Primary Examiner* — Lamson Nguyen
(74) *Attorney, Agent, or Firm* — Turocy & Watson, LLP

(57) ABSTRACT

According to one embodiment, an inkjet head includes a base including a mounting surface, an orifice plate, and a first driving element. The orifice plate includes a plurality of orifices. An ink chamber between the orifice plate and the base is configured to be supplied ink. The first driving element is arranged in the ink chamber and includes a plurality of first pressure chambers to which the orifices are opened and a plurality of first dummy chambers covered with the orifice plate, both ends of the first pressure chambers being opened to the ink chamber, both ends of the first dummy chambers being opened to the ink chamber, and the first dummy chambers being arranged alternately with the plurality of first pressure chambers.

15 Claims, 6 Drawing Sheets

INKJET HEAD AND METHOD OF MANUFACTURING THE INKJET HEAD

CROSS-REFERENCE TO RELATED APPLICATIONS

This application is based upon and claims the benefit of priority from prior Japanese Patent Application No. 2011-184540, filed on Aug. 26, 2011, the entire contents of which are incorporated herein by reference.

FIELD

Embodiments described herein relate generally to an inkjet head and a method of manufacturing the inkjet head.

BACKGROUND

In an inkjet printer head of a shear mode and shear wall system, a sidewall common to pressure chambers adjacent to each other is driven. Therefore, ink may not be able to be simultaneously ejected from the adjacent pressure chambers. Further, even if sidewalls of every other pressure chambers are simultaneously driven, it is likely that the ink is ejected by mistake from pressure chambers present among the pressure chambers from which the ink is ejected.

In order to prevent the mis-ejection of the ink, sidewalls of at least every two other pressure chambers are simultaneously driven (three-division driving). If the three-division driving is performed, a driving frequency of an inkjet head is delayed. Therefore, in order to improve the driving frequency, pressure chambers for ejecting the ink and dummy chambers for not ejecting the ink are sometimes alternately provided. In the pressure chambers, orifices from which the supplied ink is ejected are opened. On the other hand, the dummy chambers are closed without being provided with orifices. The ink is only filled in the dummy chambers.

Since the pressure chambers and the dummy chambers are alternately arranged, even if sidewalls of driving elements forming the pressure chambers are deformed in a shear mode, the mis-ejection of the ink is prevented. This makes it possible to simultaneously eject the ink from the pressure chambers and improve the driving frequency of the inkjet head.

Further, pressure chambers and air chambers containing the air without being provided with orifices are sometimes alternately provided. This also prevents the mis-ejection of the ink and makes it possible to simultaneously eject the ink from the pressure chambers.

For example, since the orifices are not provided in the dummy chambers, it is likely that the ink is not sufficiently filled in the dummy chambers and the air accumulates in the dummy chambers. If amounts of the air accumulating in the dummy chambers are different from one another, crosstalk amounts of the pressure chambers are different. Since the supplied ink accumulates in the dummy chambers, it is likely that the temperature of the ink in the dummy chambers rises and affects the ink ejection from the pressure chambers.

If the air chambers are provided, a structure for preventing the ink from entering the air chambers is necessary. Therefore, the structure of the inkjet head is complicated and costs and labor and time for manufacturing the inkjet head increase.

DETAILED DESCRIPTION

In general, according to one embodiment, an inkjet head includes a base, an orifice plate, and a first driving element. The base includes a mounting surface. The orifice plate is opposed to the mounting surface to form an ink chamber being configured to be supplied ink between the orifice plate and the base, and includes a plurality of orifices. The first driving element is arranged in the ink chamber and attached to the mounting surface and includes a plurality of groove-like first pressure chambers to which the orifices are opened and a plurality of groove-like first dummy chambers covered with the orifice plate, both ends of the first pressure chambers being opened to the ink chamber, both ends of the first dummy chambers being opened to the ink chamber, and the first dummy chambers being arranged alternately with the plurality of first pressure chambers.

Figure 1:
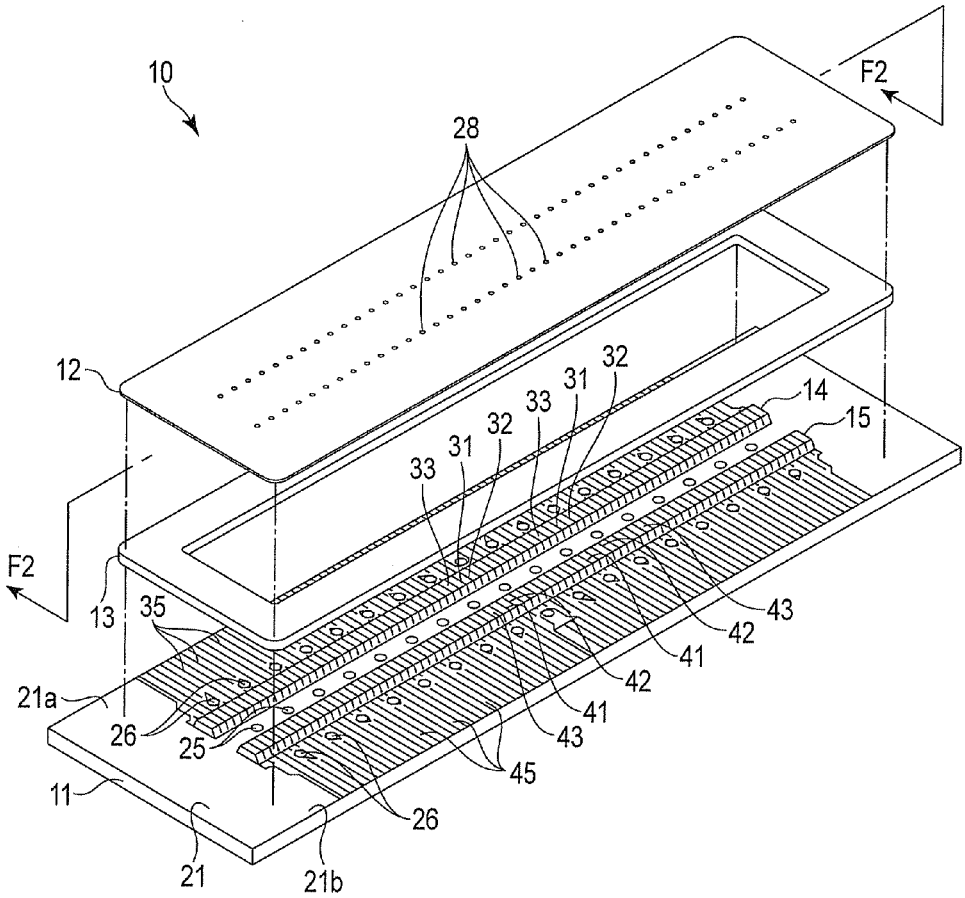
FIG. 1 is a perspective view of an inkjet head according to an embodiment.
Figure 2:
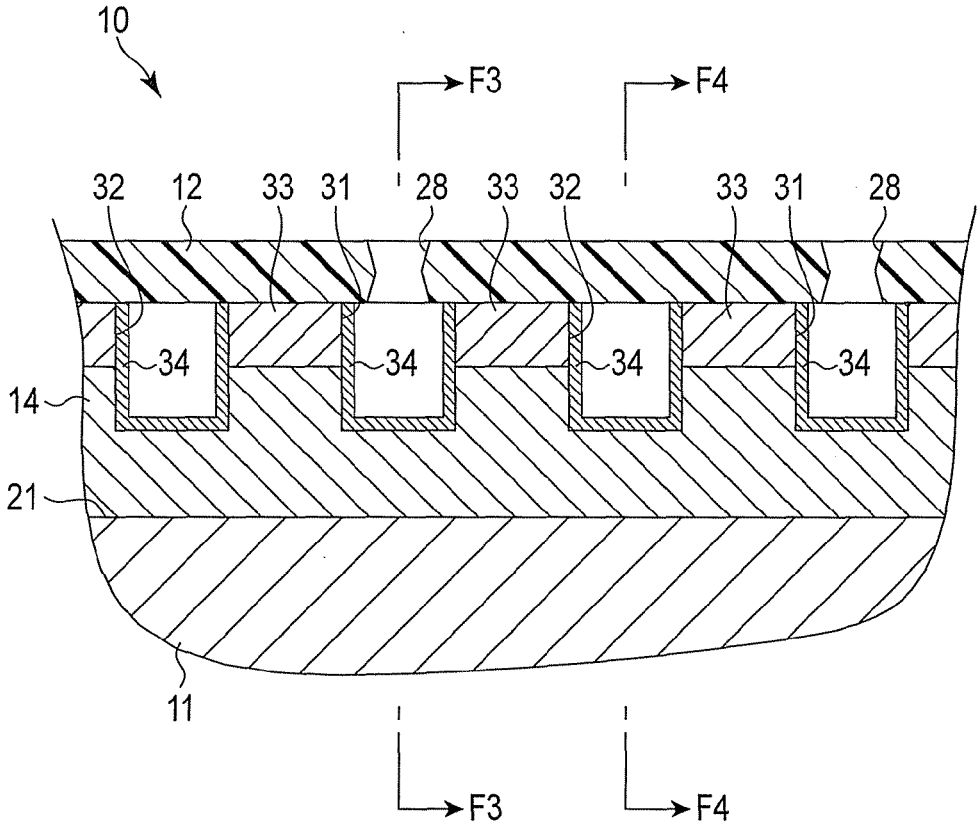
FIG. 2 is a sectional view of the inkjet head taken along line F2-F2 in FIG. 1.
Figure 3:
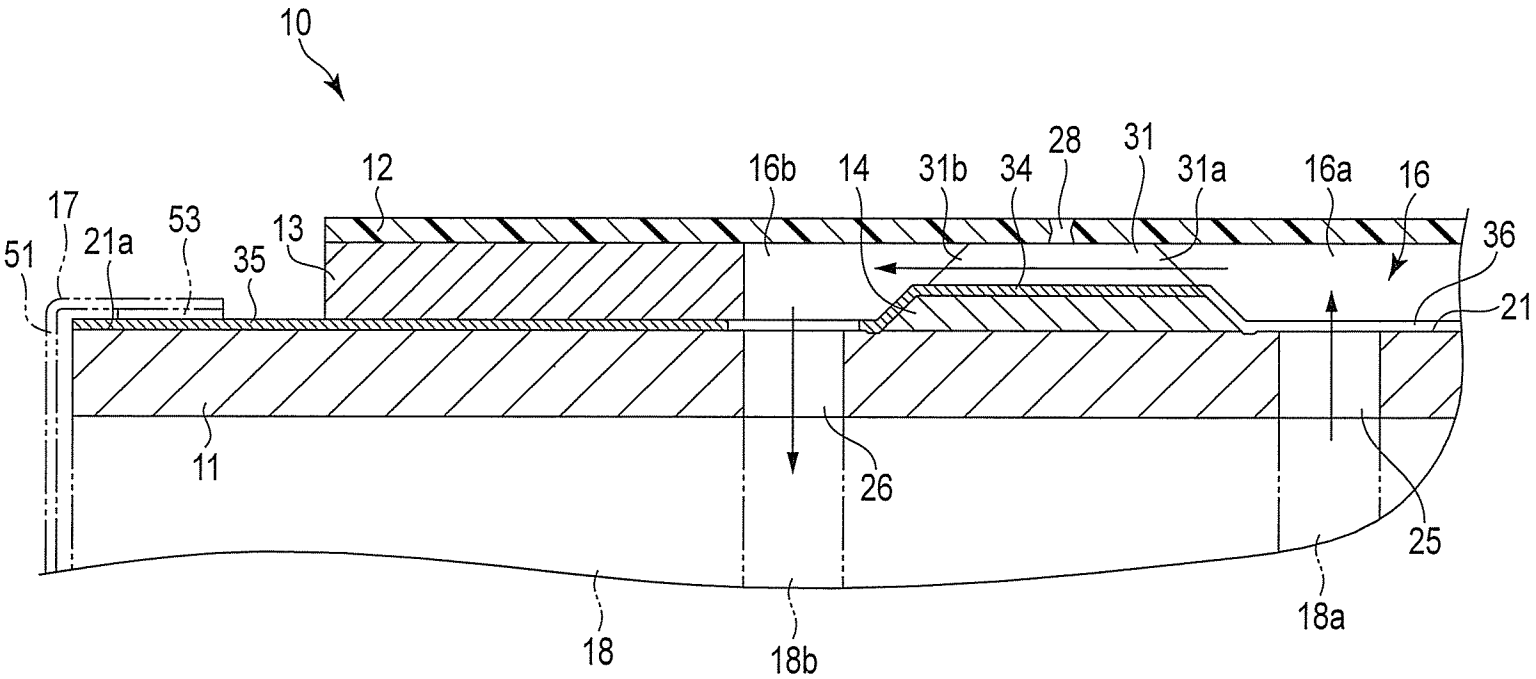
FIG. 3 is a sectional view of the inkjet head taken along line F3-F3 in FIG. 2.
Figure 4:
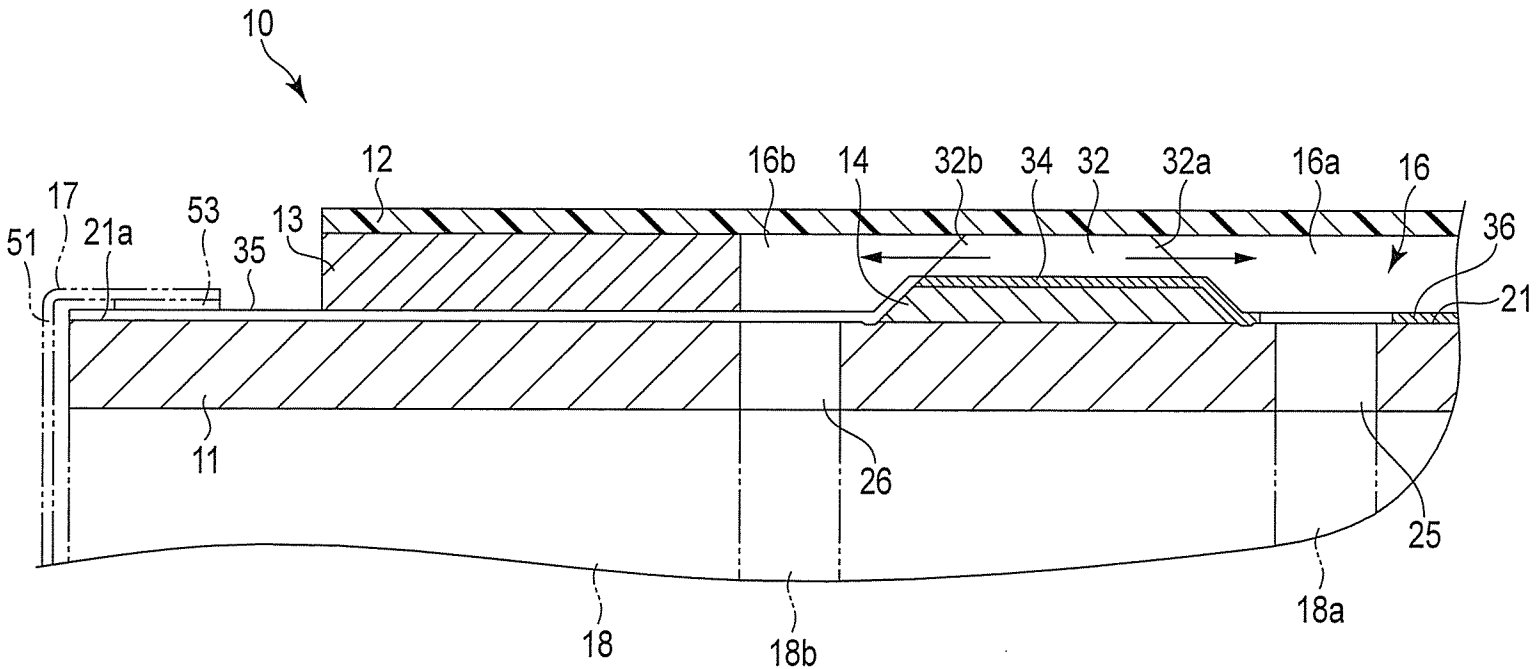
FIG. 4 is a sectional view of the inkjet head taken along line F4-F4 in FIG. 2.

An embodiment is explained below with reference to FIGS. 1 to 6. FIG. 1 is a disassembled perspective view of an inkjet head 10. FIG. 2 is a sectional view of a part of the inkjet head 10 taken along line F2-F2 in FIG. 1. FIG. 3 is a sectional view of a part of the inkjet head 10 taken along line F3-F3 in FIG. 2. FIG. 4 is a sectional view of a part of the inkjet head 10 taken along line F4-F4 in FIG. 2.

As shown in FIG. 1, the inkjet head 10 is a shear mode and shear wall system inkjet head of a so-called side shooter type. The inkjet head 10 is a device for ejecting ink and is mounted on the inside of an inkjet printer.

The inkjet head 10 includes a base plate 11, an orifice plate 12, a frame member 13, a first driving element 14, and a second driving element 15. The base plate 11 is an example of a base described in claims. As shown in FIG. 3, an ink chamber 16 to which the ink is supplied is formed on the inside of the inkjet head 10.

Further, as indicated by alternate long and two short dashes lines in FIG. 3, various components such as a circuit board 17 that controls the inkjet head 10 and a manifold 18 that forms a part of a path between the inkjet head 10 and an ink tank are attached to the inkjet head 10.

As shown in FIG. 1, the base plate 11 is formed in a rectangular plate shape by ceramics such as alumina. The base plate 11 includes a flat mounting surface 21. Plural supply holes 25 and plural discharge holes 26 are provided in the mounting surface 21.

The supply holes 25 are provided side by side in a longitudinal direction of the base plate 11 in the center of the base plate 11. As shown in FIG. 3, the supply holes 25 communicate with an ink supply section 18*a* of the manifold 18. The supply holes 25 are connected to the ink tank via the ink supply section 18*a*. As indicated by an arrow in FIG. 3, the ink in the ink tank is supplied from the supply holes 25 to the ink chamber 16.

As shown in FIG. 1, the discharge holes 26 are provided side by side in two rows across the supply holes 25. As shown in FIG. 3, the discharge holes 26 communicate with an ink discharge section 18*b* of the manifold 18. The discharge holes 26 are connected to the ink tank via the ink discharge section 18*b*. As indicated by an arrow in FIG. 3, the ink in the ink chamber 16 is discharged from the discharge holes 26 to the ink tank. In this way, the ink circulates between the ink tank and the ink chamber 16.

As shown in FIG. 1, the orifice plate 12 is formed by, for example, a rectangular film made of polyimide. The orifice plate 12 is opposed to the mounting surface 21 of the base plate 11.

Plural orifices 28 are provided in the orifice plate 12. The plural orifices 28 are arranged side by side in two rows along the longitudinal direction of the orifice plate 12. The orifices 28 are opposed to a portion between the supply holes 25 and the discharge holes 26 of the mounting surface 21.

The frame member 13 is formed in a rectangular frame shape by, for example, a nickel alloy. The frame member 13 is interposed between the mounting surface 21 of the base plate 11 and the orifice plate 12. The frame member 13 is bonded to the mounting surface 21 and the orifice plate 12. In other words, the orifice plate 12 is attached to the base plate 11 via the frame member 13.

As shown in FIG. 3, the ink chamber 16 is formed to be surrounded by the base plate 11, the orifice plate 12, and the frame member 13. In other words, the ink chamber 16 is formed between the base plate 11 and the orifice plate 12.

Each of the first and second driving elements 14 and 15 is formed by two tabular piezoelectric bodies formed by, for example, lead zirconate titanate (PZT). The two piezoelectric bodies are stuck together such that polarization directions thereof are opposite to each other in the thickness direction thereof.

The first and second driving elements 14 and 15 are bonded to the mounting surface 21 of the base plate 11. The first and second driving elements 14 and 15 are bonded to the mounting surface 21 by, for example, an epoxy adhesive having thermosetting properties.

As shown in FIG. 1, the first and second driving elements 14 and 15 are arranged in parallel side by side in the ink chamber 16 to correspond to the orifices 28 arranged side by side in two rows. As shown in FIG. 3, the first and second driving elements 14 and 15 partition the ink chamber 16 into a supply chamber 16*a* to which the supply holes 25 are opened and two discharge chambers 16*b* to which the discharge holes 26 are opened.

The first and second driving elements 14 and 15 are formed in a trapezoidal shape in cross section. The tops of the first and second driving elements 14 and 15 are bonded to the orifice plate 12.

As shown in FIG. 2, plural pressure chambers 31 and plural dummy chambers 32 are provided in the first driving element 14. The pressure chambers 31 are an example of first pressure chambers described in claims. The pressure chambers 31 and the dummy chambers 32 are respectively grooves formed in the same shape. The shape of the pressure chambers 31 and the shape of the dummy chambers 32 may be different. The first driving element 14 includes plural sidewalls 33 that form the pressure chambers 31 and the dummy chambers 32.

The pressure chambers 31 and the dummy chambers 32 are alternately arranged. The pressure chambers 31 and the dummy chambers 32 are separated from each other by the sidewalls 33. The pressure chambers 31 and the dummy chambers 32 extend in a direction crossing the longitudinal direction of the first driving element 14. The pressure chambers 31 and the dummy chambers 32 are arranged side by side in the longitudinal direction of the first driving element 14.

The plural orifices 28 of the orifice plate 12 are opened to the plural pressure chambers 31. As shown in FIG. 3, one ends 31*a* of the pressure chambers 31 are opened to the supply chamber 16*a* of the ink chamber 16. The other ends 31*b* of the pressure chambers 31 are opened to the discharge chambers 16*b* of the ink chamber 16. In other words, both the ends 31*a* and 31*b* of the pressure chambers 31 are opened to the ink chamber 16. Therefore, as indicated by an arrow in FIG. 3, the ink flows in from one ends 31*a* of the pressure chambers 31 and flows out from the other ends 31*b*.

As shown in FIG. 4, the plural dummy chambers 32 are covered with the orifice plate 12 and a part of the dummy chambers 32 are closed. One ends 32*a* of the dummy chambers 32 are opened to the supply chamber 16*a* of the ink chamber 16. The other ends 32*b* of the dummy chambers 32 are opened to the discharge chambers 16*b* of the ink chamber 16. In other words, both the ends 32*a* and 32*b* of the dummy chamber 32 are opened to the ink chamber 16. Therefore, the ink flows in from one ends 32*a* of the dummy chambers 32 and flows out from the other ends 32*b*.

As shown in FIG. 2, electrodes 34 are respectively provided in the pressure chambers 31 and the dummy chambers 32. The electrodes 34 are formed by, for example, a nickel thin film. The electrodes 34 cover the inner surfaces of the pressure chambers 31 and the dummy chambers 32.

As shown in FIG. 1, plural first wiring patterns 35 are provided extending from the mounting surface 21 of the base plate 11 to the first driving element 14. The first wiring patterns 35 are formed by, for example, a nickel thin film.

The first wiring patterns 35 respectively extend from the electrodes 34 formed in the pressure chambers 31 of the first driving element 14 to one side end 21*a* of the mounting surface 21. The side end 21*a* includes not only the edge of the mounting surface 21 but also an area around the edge. Therefore, the first wiring patterns 35 may be provided further on the inner side than the edge of the mounting surface 21.

Figure 5:
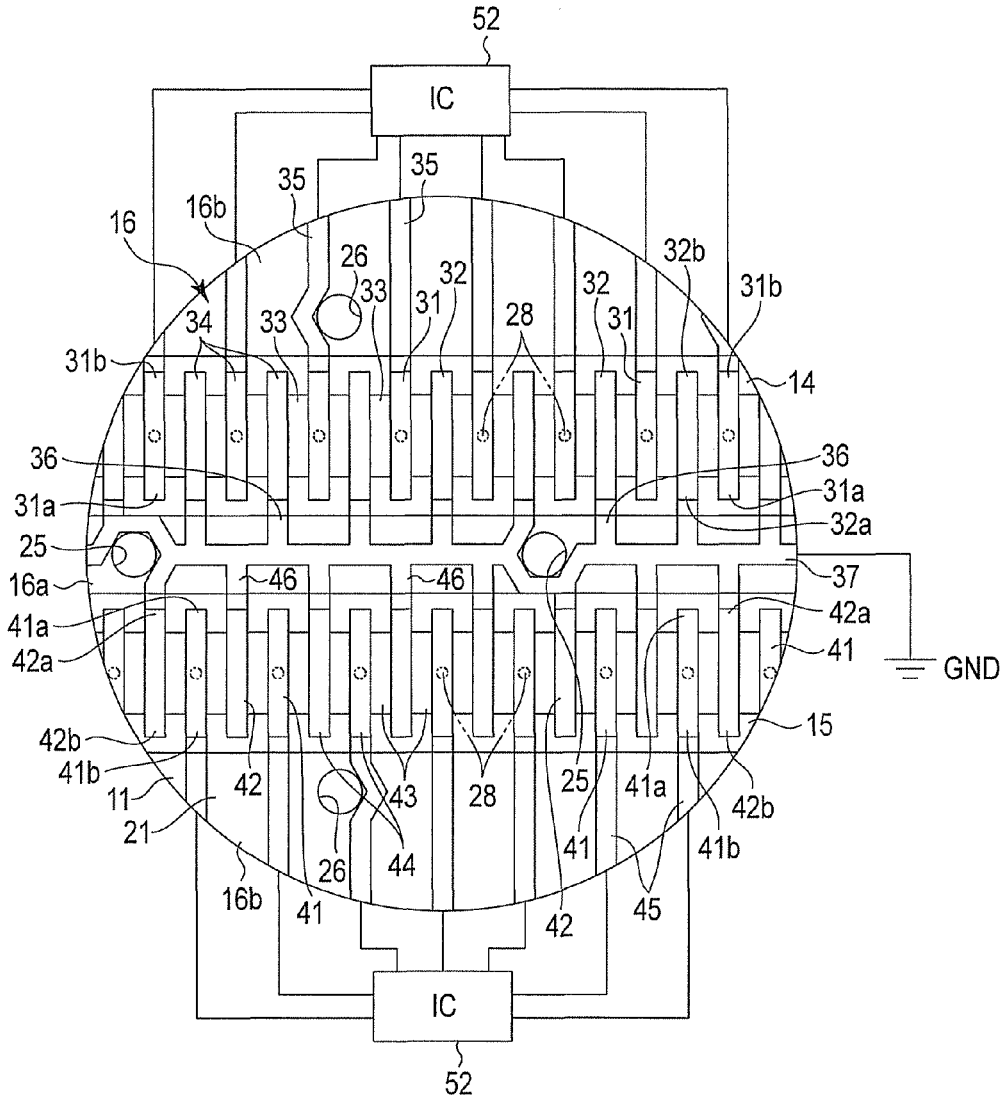
FIG. 5 is an enlarged plan view of a base plate and first and second driving elements.

FIG. 5 is an enlarged plan view of the base plate 11 and the first and second driving elements 14 and 15. In FIG. 5, for convenience of illustration, the orifices 28 are schematically shown.

As shown in FIG. 5, plural first common patterns 36 are provided extending from the mounting surface 21 of the base plate 11 to the first driving element 14. The first common patterns 36 are formed by, for example, a nickel thin film.

The first common patterns 36 respectively extend from the electrodes 34 formed in the dummy chambers 32 of the first driving element 14 to the center of the mounting surface 21. In other words, the first common patterns 36 extend in the opposite direction of the first wiring patterns 35. In another way of expression, the first common patterns 36 extend to the second driving element 15. The first common patterns 36 are combined with a common wire 37 provided in the center of the mounting surface 21.

The common wire 37 extends in the longitudinal direction of the base plate 11. The common wire 37 is formed by, for example, a nickel thin film. The common wire 37 is grounded. The common wire 37 is not limited to this. A voltage having a fixed waveform may be steadily applied to the common wire 37. In this case, the voltage having the fixed waveform is applied to the electrodes 34 of the pressure chambers 31 and electrodes 44 of pressure chambers 41 to eliminate a potential difference.

Plural pressure chambers 41 and plural dummy chambers 42 are provided in the second driving element 15. The pressure chambers 41 are an example of second pressure chambers described in claims. The dummy chambers 42 are an example of second dummy chambers described in claims. The pressure chambers 41 and the dummy chambers 42 are respectively grooves formed in the same shape. The shape of the pressure chambers 41 and the shape of the dummy chambers 42 may be different. The second driving element 15 includes plural sidewalls 43 that form the pressure chambers 41 and the dummy chambers 42.

The pressure chambers 41 and the dummy chambers 42 are alternately arranged. The pressure chambers 41 and the dummy chambers 42 are separated from each other by the sidewalls 43. The pressure chambers 41 and the dummy chambers 42 extend in a direction crossing the longitudinal direction of the second driving element 15. The pressure chambers 41 and the dummy chambers 42 are arranged side by side in the longitudinal direction of the second driving element 15.

The plural orifices 28 of the orifice plate 12 are opened to the plural pressure chambers 41. One ends 41*a* of the pressure chambers 41 are opened to the supply chamber 16*a* of the ink chamber 16. The other ends 41*b* of the pressure chambers 41 are opened to the discharge chambers 16*b* of the ink chamber 16. In other words, both the ends 41*a* and 41*b* of the pressure chambers 41 are opened to the ink chamber 16. Therefore, the ink flows in from one ends 41*a* of the pressure chambers 41 and flows out from the other ends 41*b*.

The plural dummy chambers 42 are covered with the orifice plate 12. A part of the dummy chambers 42 are closed by the orifice plate 12. One ends 42*a* of the dummy chambers 42 are opened to the supply chamber 16*a* of the ink chamber 16. The other ends 42*b* of the dummy chambers 42 are opened to the discharge chambers 16*b* of the ink chamber 16. In other words, both the ends 42*a* and 42*b* of the dummy chambers 42 are opened to the ink chamber 16. Therefore, the ink flows in from one ends 42*a* of the dummy chambers 42 and flows out from the other ends 42*b*.

The electrodes 44 are respectively provided in the pressure chambers 41 and the dummy chambers 42. The electrodes 44 are formed by, for example, a nickel thin film. The electrodes 44 cover the inner surfaces of the pressure chambers 41 and the dummy chambers 42.

As shown in FIG. 1, plural second wiring patterns 45 are provided extending from the mounting surface 21 of the base plate 11 to the second driving element 15. The second wiring patterns 45 are formed by, for example, a nickel thin film.

The second wiring patterns 45 respectively extend from the electrodes 44 formed in the pressure chambers 41 of the second driving element 15 to the other side end 21*b* of the mounting surface 21. The side end 21*b* includes not only the edge of the mounting surface 21 but also an area around the edge. Therefore, the second wiring patterns 45 may be provided further on the inner side than the edge of the mounting surface 21.

As shown in FIG. 5, plural second common patterns 46 are provided extending from the mounting surface 21 of the base plate 11 to the second driving element 15. The second common patterns 46 are formed by, for example, a nickel thin film.

The second common patterns 46 respectively extend from the electrodes 44 formed in the dummy chambers 42 of the second driving element 15 to the center of the mounting surface 21. In other words, the second common patterns 46 extend to the first driving element 14.

The second common patterns 46 are combined with the common wire 37. The second common patterns 46 are combined with the first common patterns 36 via the common wire 37. Consequently, the first and second common patterns 36 and 46 and the common wire 37 have the same potential.

As shown in FIG. 3, the circuit board 17 is a film carrier package (FCP). The circuit board 17 includes a film 51 made of resin having plural wires formed thereon and having flexibility and an IC 52 (shown in FIG. 5) connected to the plural wires of the film 51. The FCP is also referred to as tape carrier package (TCP).

The film 51 is tape automated bonding (TAB). The IC 52 is a component for applying a voltage to the electrodes 34 and 44. The IC 52 is fixed to the film 51 by, for example, resin.

An end of the film 51 is thermocompression-bonded and connected to the first and second wiring patterns 35 and 45 by an anisotropic conductive film (ACF) 53. Consequently, the plural wires of the film 51 are electrically connected to the first and second wiring patterns 35 and 45.

Since the film 51 is connected to the first and second wiring patterns 35 and 45, as shown in FIG. 5, the IC 52 is electrically connected to the electrodes 34 and 44 via the wires of the film 51.

An example of a method of driving the inkjet head 10 is explained below. As shown in FIG. 3, the ink in the ink tank is supplied from the supply holes 25 to the supply chamber 16*a* of the ink chamber 16 through the ink supply section 18*a* of the manifold 18. The ink is supplied to the plural pressure chambers 31 and 41 and the plural dummy chambers 32 and 42 of the first and second driving elements 14 and 15.

The ink flows into the discharge chambers 16*b* of the ink chamber 16 through the pressure chambers 31 and 41 and the dummy chambers 32 and 42. The ink is discharged from the discharge holes 26 to the ink tank through the ink discharge section 18*b* of the manifold 18.

Figure 6:
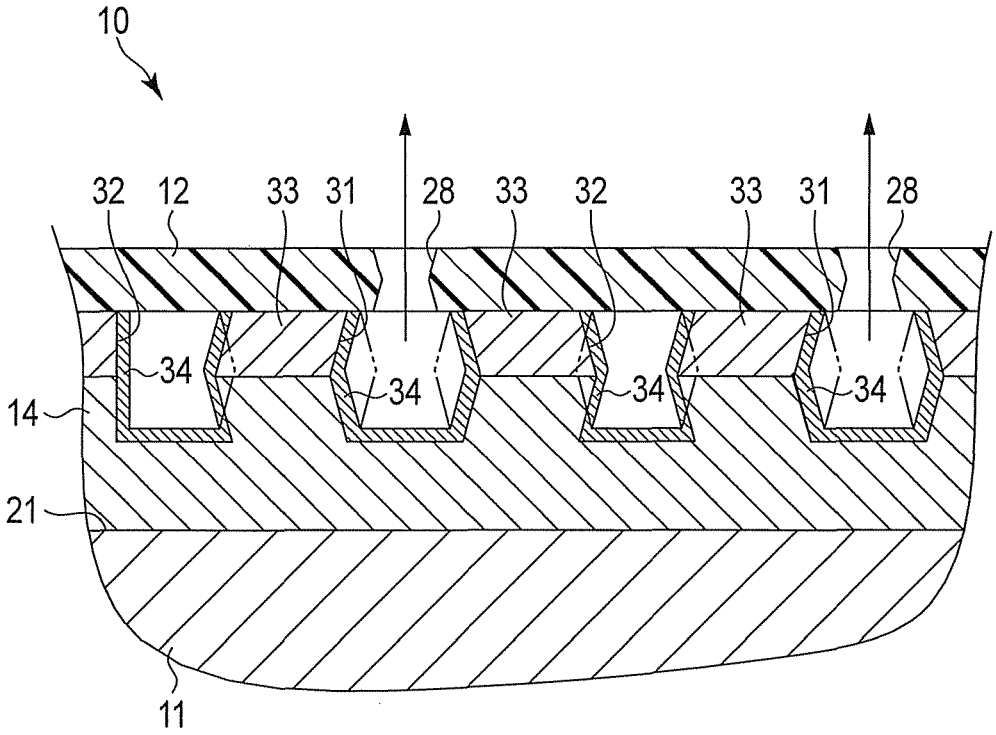
FIG. 6 is a sectional view of the inkjet head, sidewalls of which are deformed in a shear mode.

FIG. 6 is a sectional view of the inkjet head 10, the sidewalls 33 of which are deformed in a shear mode. The IC 52 applies, on the basis of a signal input from a control section of the inkjet printer, a driving voltage to the electrodes 34 and 44 of the pressure chambers 31 and 41 via the wires of the film 51. Consequently, a potential difference occurs between the electrodes 34 and 44 of the pressure chambers 31 and 41 and the electrodes 34 and 44 of the dummy chambers 32 and 42 grounded via the common wire 37. The sidewalls 33 and 43 are deformed in the shear mode.

As shown in FIG. 6, the sidewalls 33 and 43 are deformed in the shear mode, whereby the volume of the pressure chambers 31 and 41, in which the electrodes 34 and 44 are provided, increases and the pressure in the pressure chambers 31 and 41 decreases. Consequently, the ink in the ink chamber 16 flows into the pressure chambers 31 and 41.

On the other hand, the volume of the dummy chambers 32 and 42 adjacent to the pressure chambers 31 and 41 decreases and the pressure in the dummy chambers 32 and 42 increases. As indicated by an arrow in FIG. 4, when the pressure in the dummy chambers 32 and 42 increases, the ink in the dummy chambers 32 and 42 flows out from both the ends 32*a* and 32*b* and 42*a* and 42*b* of the dummy chambers 32 and 42 to the ink chamber 16 to reduce a pressure change in the dummy chambers 32 and 42.

In a state in which the volume of the pressure chambers 31 and 41 increases, the IC 52 applies a driving voltage of the opposite potential to the electrodes 34 and 44 of the pressure chambers 31 and 41. Consequently, as indicated by alternate long and two short dashes lines in FIG. 6, the sidewalls 33 and 43 are deformed in the shear mode, the volume of the pressure chambers 31 and 41, in which the electrodes 34 and 44 are provided, decreases, and the pressure in the pressure chambers 31 and 41 increases. Consequently, the ink in the pressure chambers 31 and 41 are pressurized and discharged from the orifices 28.

In the inkjet head 10 having the configuration explained above, the pressure chambers 31 and 41 and the dummy chambers 32 and 42 are alternately arranged. Consequently, the ink can be simultaneously discharged from the pressure chambers 31 and 41 and a driving frequency of the inkjet head 10 is improved.

Both the ends 32*a* and 32*b* and 42*a* and 42*b* of the dummy chambers 32 and 42 are opened to the ink chamber 16. Therefore, it is possible to easily fill the ink in the dummy chambers 32 and 42 and suppress the air from staying in the dummy chambers 32 and 42. Further, since the ink in the dummy chambers 32 and 42 flows from the supply chamber 16*a* of the ink chamber 16 to the discharge chambers 16*b*, it is possible to suppress the temperature of the ink in the dummy chambers 32 and 42 from rising. Consequently, even if the dummy chambers 32 and 42 are provided, it is possible to suppress an influence on the ink discharge due to a difference between crosstalk amounts of the pressure chambers 31 and 41 and a rise in the temperature of the ink in the dummy chambers 32 and 42.

Further, the pressure chambers 31 and 41 and the dummy chambers 32 and 42 are formed in the same shape and are different only in that whether the orifices 28 are opened. The influence on the ink discharge is suppressed by such a simple structure. Therefore, it is possible to suppress manufacturing costs for the inkjet head 10.

If the pressure in the dummy chambers 32 and 42 increases because the sidewalls 33 and 34 are deformed in the shear mode, the ink in the dummy chambers 32 and 42 flows out from both the ends 32*a* and 32*b* and 42*a* and 42*b* of the dummy chambers 32 and 42 to the ink chamber 16 to reduce a pressure change in the dummy chambers 32 and 42. Consequently, suppression of crosstalk is expected.

The first and second common patterns 36 and 46 respectively extend in the opposite directions of the first and second wiring patterns 35 and 45. Consequently, it is possible to reduce the resolutions of the patterns 35, 36, 45, and 46 and patterning for forming the patterns 35, 36, 45, and 46 is facilitated.

The first and second common patterns 36 and 46 are combined with the common wire 37. The first and second common patterns 36 and 46 are connected to the electrodes 34 and 44 of the dummy chambers 32 and 42 that do not perform ink discharge. Therefore, the first and second common patterns 36 and 46 may have the same potential. Consequently, it is possible to reduce the wires on the mounting surface 21 and patterning for forming the first and second common patterns 36 and 46 is facilitated.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An inkjet head comprising:

a base comprising a mounting surface;

an orifice plate opposed to the mounting surface to form an ink chamber being configured to be supplied ink between the orifice plate and the base, and comprising a plurality of orifices; and a first driving element arranged in the ink chamber and attached to the mounting surface and comprising a plurality of groove-like first pressure chambers to which the orifices are opened and a plurality of groove-like first dummy chambers covered with the orifice plate, both ends of the first pressure chambers being opened to the ink chamber, both ends of the first dummy chambers being opened to the ink chamber, and the first dummy chambers being arranged alternately with the plurality of first pressure chambers.

2. The inkjet head of claim 1, further comprising:

a plurality of wiring patterns provided on the mounting surface of the base respectively extending from the first pressure chambers; and a plurality of first common patterns provided on the mounting surface of the base respectively extending from the first dummy chambers in an opposite direction of the wiring patterns.

3. The inkjet head of claim 2, wherein the plurality of first common patterns are combined.

4. The inkjet head of claim 2, further comprising:

a second driving element arranged side by side with the first driving element and attached to the mounting surface and comprising a plurality of groove-like second pressure chambers to which the orifices are opened and a plurality of groove-like second dummy chambers covered with the orifice plate, both ends of the second pressure chambers being opened to the ink chamber, both end of the second dummy chambers being opened to the ink chamber, and the second dummy chambers being arranged alternately with the plurality of second pressure chambers; and a plurality of second common patterns respectively extending from the second dummy chambers to the first driving element and provided on the mounting surface of the base, wherein the first common patterns extend to the second driving element.

5. The inkjet head of claim 3, further comprising:

a second driving element arranged side by side with the first driving element and attached to the mounting surface and comprising a plurality of groove-like second pressure chambers to which the orifices are opened and a plurality of groove-like second dummy chambers covered with the orifice plate, both ends of the second pressure chambers being opened to the ink chamber, both end of the second dummy chambers being opened to the ink chamber, and the second dummy chambers being arranged alternately with the plurality of second pressure chambers; and a plurality of second common patterns respectively extending from the second dummy chambers to the first driving element and provided on the mounting surface of the base, wherein the first common patterns extend to the second driving element.

6. The inkjet head of claim 4, wherein the first common patterns and the second common patterns are combined.

7. The inkjet head of claim 5, wherein the first common patterns and the second common patterns are combined.

8. An inkjet head comprising:

a base comprising a mounting surface on which a supply hole from which ink is supplied and a discharge hole from which the ink is discharged are provided;

an orifice plate opposed to the mounting surface to form an ink chamber, to which the supply hole and the discharge hole are opened, between the orifice plate and the base and comprising a plurality of orifices; and a first driving element arranged between the supply hole and the discharge hole and attached to the mounting surface and comprising a plurality of groove-like first pressure chambers to which the orifices are opened, the first pressure chambers comprising first ends into which the ink flows and second ends from which the ink flows out, and a plurality of groove-like first dummy chambers covered with the orifice plate, the first dummy chambers comprising first ends into which the ink flows and second ends from which the ink flows out and being arranged alternately with the plurality of first pressure chambers.

9. The inkjet head of claim 8, further comprising:

a plurality of wiring patterns provided on the mounting surface of the base respectively extending from the first pressure chambers; and a plurality of first common patterns provided on the mounting surface of the base respectively extending from the first dummy chambers in an opposite direction of the wiring patterns.

10. The inkjet head of claim 9, wherein the plurality of first common patterns are combined.

11. The inkjet head of claim 9, further comprising:

a second driving element arranged side by side with the first driving element and attached to the mounting surface and comprising a plurality of groove-like second pressure chambers to which the orifices are opened, the second pressure chambers comprising first ends into which the ink flows and second ends from which the ink flows out, and a plurality of groove-like second dummy chambers covered with the orifice plate, the second dummy chambers comprising first ends into which the ink flows and second ends from which the ink flows out and being arranged alternately with the plurality of second pressure chambers; and a plurality of second common patterns respectively extending from the second dummy chambers to the first driving element and provided on the mounting surface of the base, wherein the first common patterns extend to the second driving element.

12. The inkjet head of claim 10, further comprising:

a second driving element arranged side by side with the first driving element and attached to the mounting surface and comprising a plurality of groove-like second pressure chambers to which the orifices are opened, the second pressure chambers comprising first ends into which the ink flows and second ends from which the ink flows out, and a plurality of groove-like second dummy chambers covered with the orifice plate, the second dummy chambers comprising first ends into which the ink flows and second ends from which the ink flows out and being arranged alternately with the plurality of second pressure chambers; and a plurality of second common patterns respectively extending from the second dummy chambers to the first driving element and provided on the mounting surface of the base, wherein the first common patterns extend to the second driving element.

13. The inkjet head of claim 11, wherein the first common patterns and the second common patterns are combined.

14. The inkjet head of claim 12, wherein the first common patterns and the second common patterns are combined.

15. A method of manufacturing an inkjet head, the inkjet head comprising:

a base comprising a mounting surface on which a supply hole from which ink is supplied and a discharge hole from which the ink is discharged are provided;

an orifice plate opposed to the mounting surface to form an ink chamber, to which the supply hole and the discharge hole are opened, between the orifice plate and the base and comprising a plurality of orifices; and a driving element arranged between the supply hole and the discharge hole and attached to the mounting surface and comprising a plurality of groove-like pressure chambers comprising one ends into which the ink flows and other ends from which the ink flows out and a plurality of groove-like dummy chambers comprising one ends into which the ink flows and other ends from which the ink flows out and arranged alternately with the plurality of pressure chambers, the method comprising:

attaching the driving element to the mounting surface of the base; and attaching the orifice plate to the base such that the orifices are opened to the pressure chambers and the orifice plate closes a part of the dummy chambers.

* * * * *